US006929295B2

(12) United States Patent
Nurenberg et al.

(10) Patent No.: US 6,929,295 B2
(45) Date of Patent: Aug. 16, 2005

(54) STORAGE COMPARTMENT AND LATCH ARRANGEMENT THEREOF

(75) Inventors: Randy William Nurenberg, Hudsonville, MI (US); Joel Evan Vanden Heuvel, Zeeland, MI (US); Allan Wayne Getliff, Holland, MI (US); Kathleen Margaret Lathrop, Berlkley, MI (US)

(73) Assignees: Johnson Controls, Inc., Holland, MI (US); Mitsubishi Jidosha Kogyo Kabushiki Kaisha (JP)

( * ) Notice: Subject to any disclaimer, the term of this patent is extended or adjusted under 35 U.S.C. 154(b) by 0 days.

(21) Appl. No.: 10/337,915

(22) Filed: Jan. 7, 2003

(65) Prior Publication Data

US 2004/0130165 A1 Jul. 8, 2004

(51) Int. Cl.[7] ..... E05B 3/00

(52) U.S. Cl. ..... 292/336.3; 292/102; 292/107; 292/DIG. 53; 292/DIG. 63; 296/24.34

(58) Field of Search ..... 292/116, 120, 292/213, 218; 296/24.34, 336.3, DIG. 61, DIG. 53, DIG. 31, DIG. 27, DIG. 63, 102, 107, 56; 224/400, 401, 275, 282

(56) References Cited

U.S. PATENT DOCUMENTS 3,490,805 A * 1/1970 Mastrovito et al. ..... 292/258
4,320,834 A * 3/1982 Tamaki ..... 206/404
4,580,821 A * 4/1986 Genord et al. ..... 292/336.3
4,723,812 A * 2/1988 Masuda et al. ..... 296/224
4,739,896 A * 4/1988 Moss ..... 52/169.6
4,743,060 A * 5/1988 Hishida ..... 296/37.12
4,784,414 A * 11/1988 Free ..... 292/52
4,848,627 A * 7/1989 Maeda et al. ..... 224/275
4,893,850 A * 1/1990 Mizusawa ..... 292/128
4,925,072 A * 5/1990 Masler et al. ..... 224/282
4,940,140 A * 7/1990 Posso ..... 206/405
5,116,099 A * 5/1992 Kwasnik et al. ..... 297/188.15
5,167,351 A * 12/1992 Prout et al. ..... 220/840
5,484,178 A * 1/1996 Sandhu et al. ..... 292/173
5,651,163 A * 7/1997 Tamaki ..... 292/336.3
5,868,448 A * 2/1999 Izumo ..... 296/37.1
5,887,929 A * 3/1999 Miller et al. ..... 296/37.8
5,987,943 A * 11/1999 Verga et al. ..... 70/208
6,059,243 A * 5/2000 Hikage et al. ..... 248/311.2
6,085,953 A * 7/2000 Bober et al. ..... 224/282
6,152,512 A * 11/2000 Brown et al. ..... 296/37.12
6,296,285 B1 * 10/2001 Alvring et al. ..... 292/146
6,349,450 B1 * 2/2002 Koops et al. ..... 292/336.3
6,508,495 B1 * 1/2003 Riley ..... 292/152
6,513,354 B2 * 2/2003 Predd et al. ..... 70/208

* cited by examiner

*Primary Examiner*—Daniel P. Stodola
*Assistant Examiner*—Carlos Lugo
(74) *Attorney, Agent, or Firm*—Rossi, Kimms & McDowell, LLP

(57) ABSTRACT

A latch device for a cover member includes a box body having at least of a pair of walls and an upside opening, a cover member that is mounted on the box body to enable the upside opening to be opened and closed, a handle member mounted on the cover member such that the handle member may rotate. The handle member includes a pair of claws formed at both ends of the cover member; and latch holes formed in the walls of the box body such that the pair of claws are engaged with the latch holes.

7 Claims, 6 Drawing Sheets

STORAGE COMPARTMENT AND LATCH ARRANGEMENT THEREOF

BACKGROUND OF THE INVENTION

The present invention relates to a latch device for a cover member.

A console box for storing small items is generally mounted between a driver seat and a passenger seat in a vehicle compartment. As disclosed in U.S. Pat. No. 4,848,627, for example, a conventional console box is comprised of a box body that usually extends in the direction of the length of a vehicle and a cover member that opens and closes an upside opening of the box body. The cover member includes a lock member disposed at the front thereof in the direction of the length of the vehicle. The cover member can be closed by engaging the lock member with a latch hole formed in a front wall of the box body.

The structure of the conventional console box, however, has the problem that the degree of freedom in designing the wall of the boxy body is restricted, because the position where the lock member is engaged with the latch hole lies at the center of the wall constituting the box body. It is therefore impossible to effectively use the wall of the box body.

In view of the above, it would be desirable to provide a latch device for a cover member, which makes it possible to effectively use walls of a box body.

SUMMARY OF THE INVENTION

The present invention provides a latch device for a cover member, comprising: a box body comprising at least of a pair of walls and an upside opening; a cover member that is mounted on the box body to enable the upside opening to be opened and closed; a handle member mounted on the cover member such that the handle member may rotate, the handle member comprising a pair of claws formed at both ends of the cover member; and latch holes formed in the walls of the box body such that the pair of claws are engaged with the latch holes.

BRIEF DESCRIPTION OF DRAWINGS

The invention will be explained in greater detail with the references to the accompanying drawings, in which like reference character designate the same or similar parts throughout the figure and wherein.

DETAILED DESCRIPTION OF THE PREFERRED EMBODEMENTS

The present invention will now be described in detail with reference to the drawings showing a preferred embodiment thereof.

Figure 1:
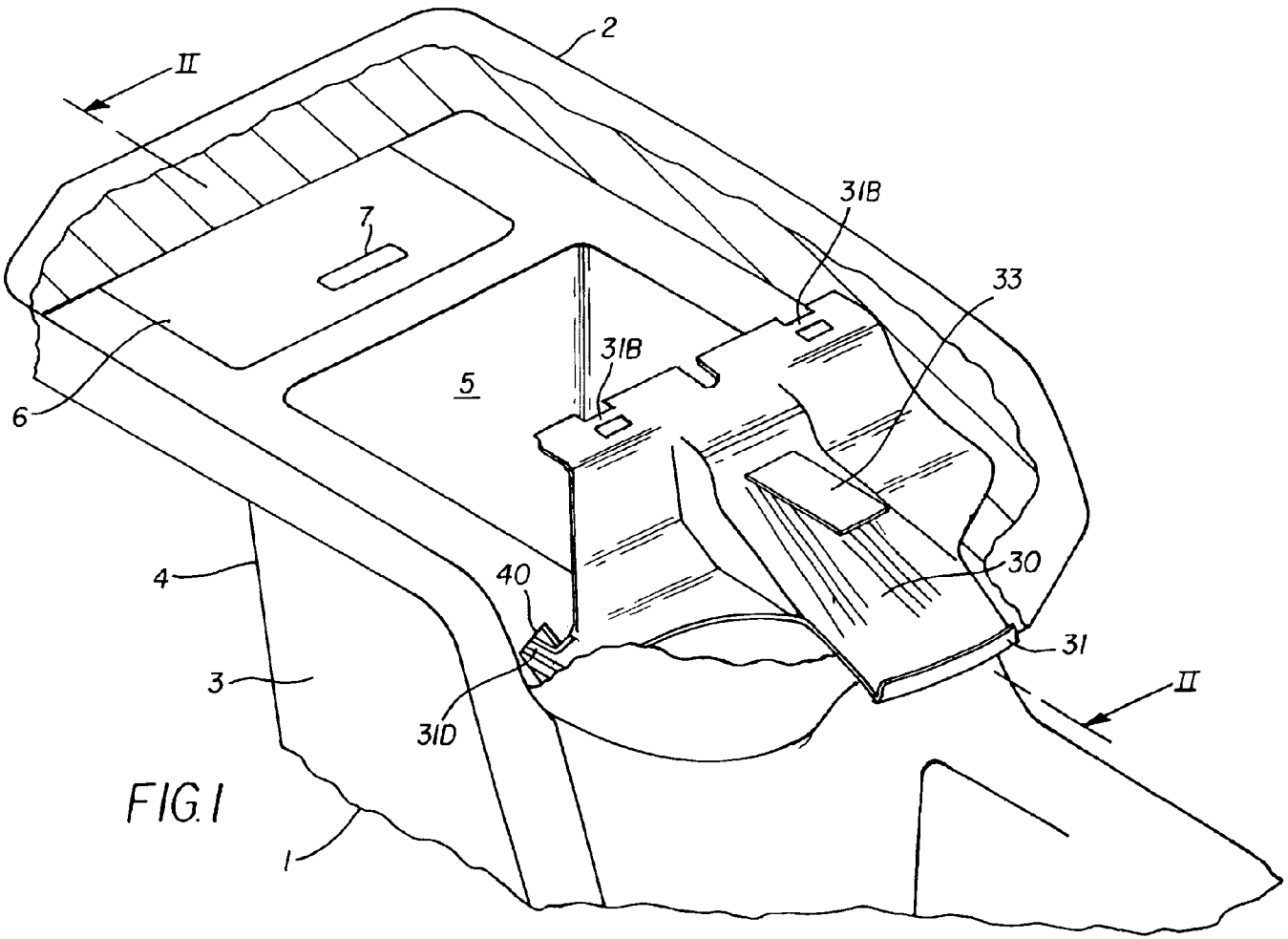
FIG. 1 is an enlarged perspective view showing the upper part of a console box including a latch device for a cover member according to an embodiment of the present invention.
Figure 2:
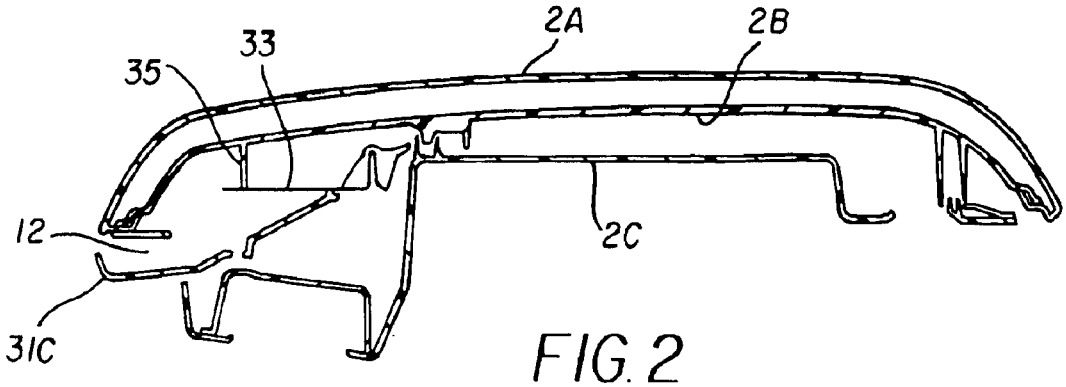
FIG. 2 is a view taken along an arrow II—II of FIG. 1.

FIG. 1 shows a box body 1 of a console box, which is mounted between a driver seat and a passenger seat, neither of which is illustrated, and a cover member 2 (illustrated as partially cut away) that enables an upside opening of the box body 1 to be opened and closed. As shown in FIGS. 1 and 2, the box body 1 is enclosed by a pair of side walls 3 located at the right and left in the direction of the width of a vehicle, a rear wall 4 located at the rear in the direction of the length of the vehicle, and a bottom part, not shown, to form a storage chamber 5 that is capable of storing small items and the like. The cover member 2 is attached to the rear wall 4 of the box body 1 via a hinge device 20 (shown in detail in FIG. 5) such that the cover member 2 may open upward.

Figure 5:
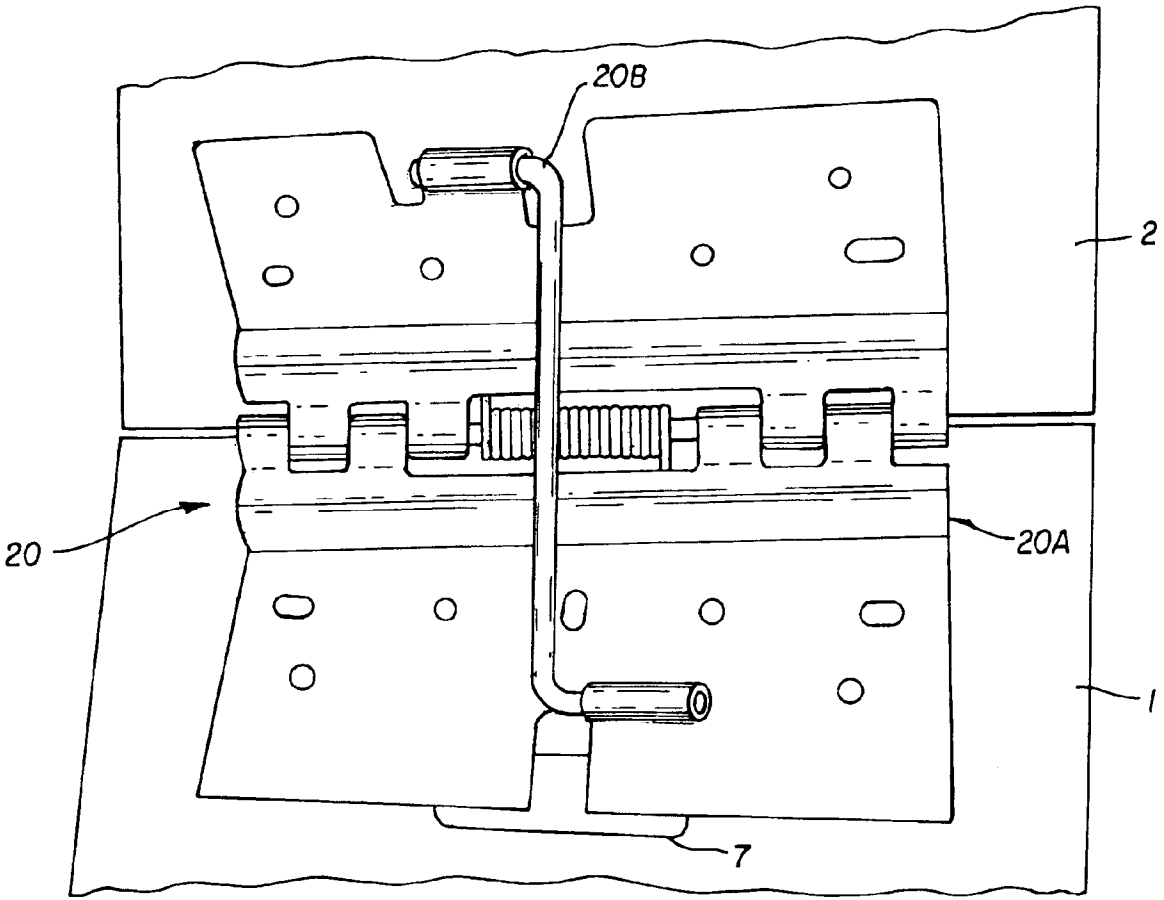
FIG. 5 is a perspective view showing a hinge device 20.

The hinge device 20 is comprised of a hinge 20A and a restricting member 20B as shown in greater detail in FIG. 5. The hinge 20A is fixed to the rear part of a bottom surface of the cover member 2 and to a mounting surface 6 of the box body 1 by screws. Both ends of the restricting member 20B are bent to be substantially L-shaped. A first end of the restricting member 20B is attached to the portion of the hinge 20A that is connected to the cover member 2. A second end of the restricting member 20B is made to slide into an opening 7 provided in the mounting surface 6 of the box body 1. In the drawing, the second end is shown not yet inserted into the opening 7 for purposes of illustration. Specifically, when the cover member 2 is closed, almost the entire restricting member 20B except for the upper end thereof is stored in a space located at the rear of the rear wall 4. When the cover member 2 is closed, the restricting member 20B protrudes from the mounting surface to turn the cover member 2 by a length corresponding to that of the restricting member 20B. Namely, the restricting member 20B restricts the opening of the cover member 2. The hinge device 20 constructed as described above makes it possible to effectively use the space at the rear of the box body 1, and has a structure suitable for disposing an air conditioning device.

Figure 3:
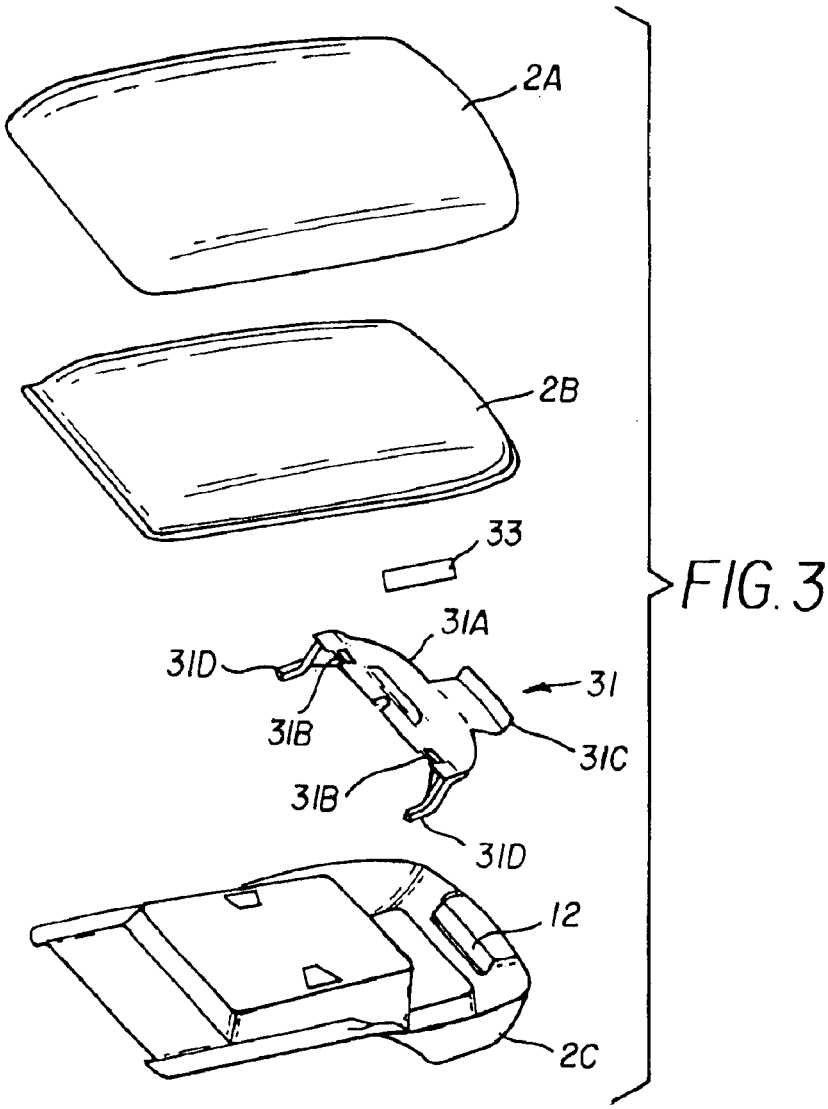
FIG. 3 is an exploded view showing the essential parts of a cover member 2 having a latch device 30.
Figure 7:
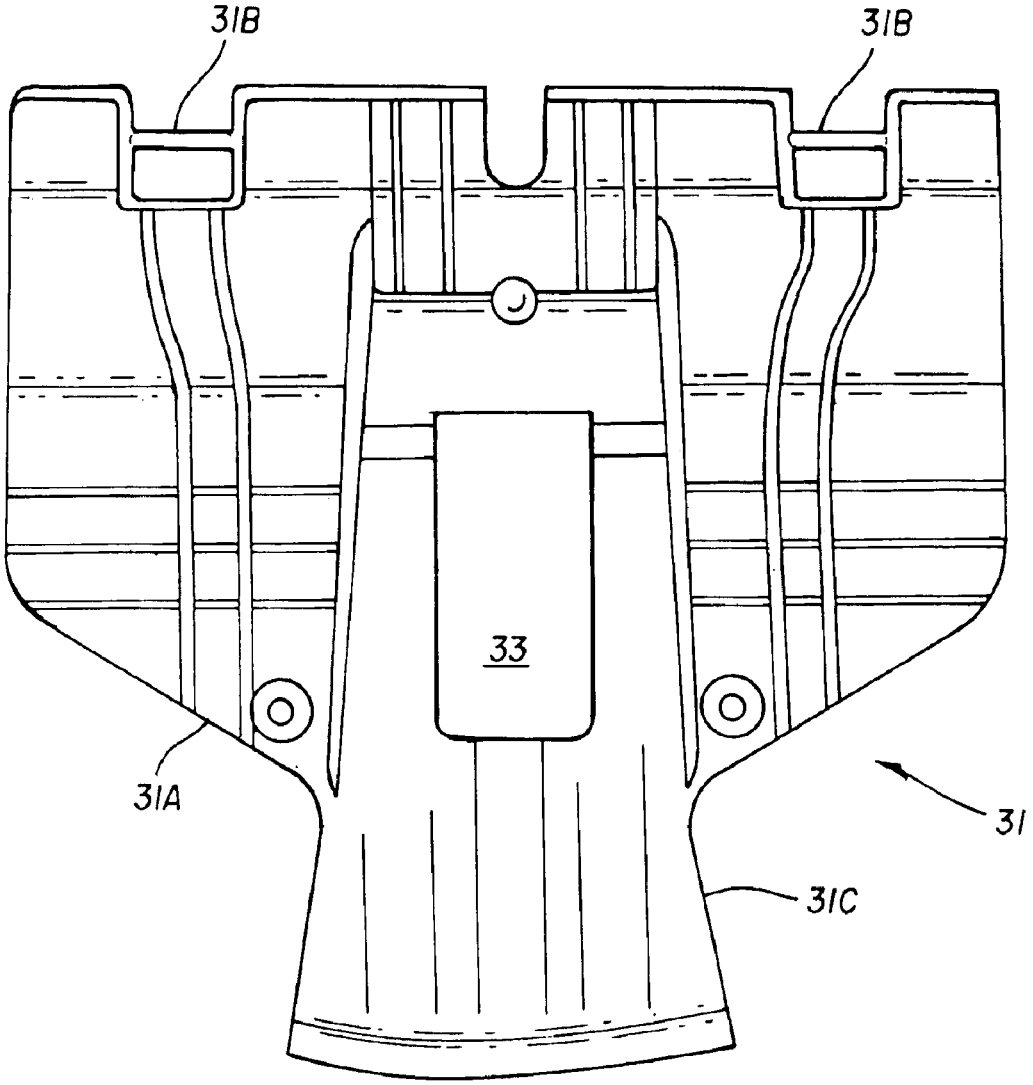
FIG. 7 is a top view of the latch device.
Figure 8:
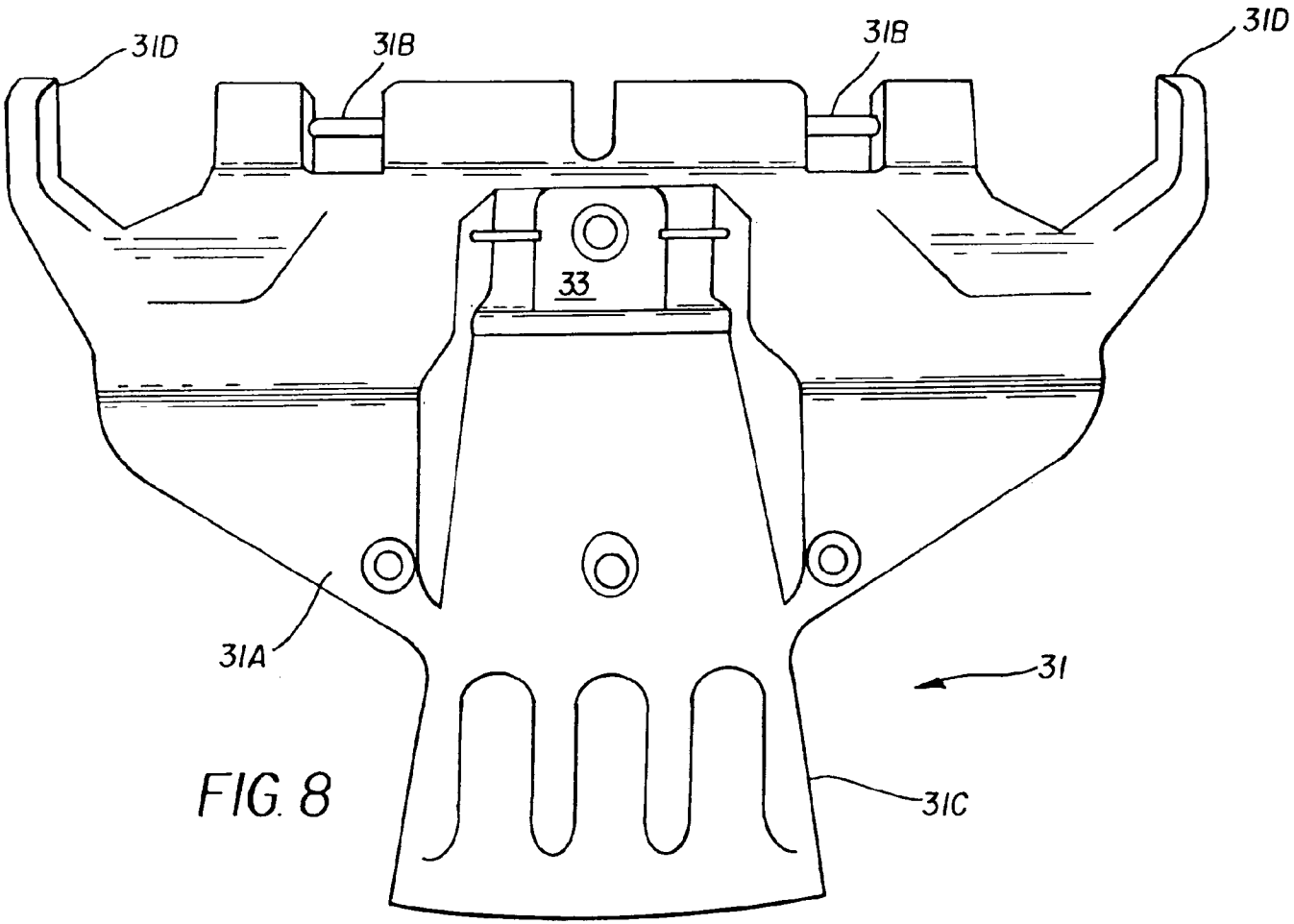
FIG. 8 is a bottom view of the latch device.

In the present embodiment, the cover member 2 also serves an arm rest, and is comprised of an arm rest shell 2A, an internal member 2B, and an external member 2C as shown in FIG. 3. These component parts of the cover member 2 are joined to each other by screws (not shown). The cover member 2 is also provided with a latch device 30 that is intended to keep the cover member 2 in a closed state. As illustrated in FIG. 1, the latch device 30 is comprised of a handle member 31 and a spring member 33. Detailed illustrations of the latch device are provided in FIGS. 7 and 8.

Figure 4:
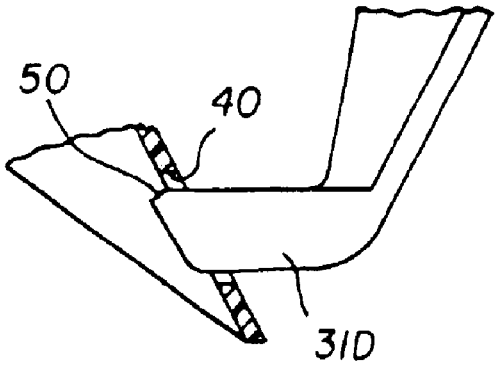
FIG. 4 is an enlarged view showing a claw part 31D.
Figure 6:
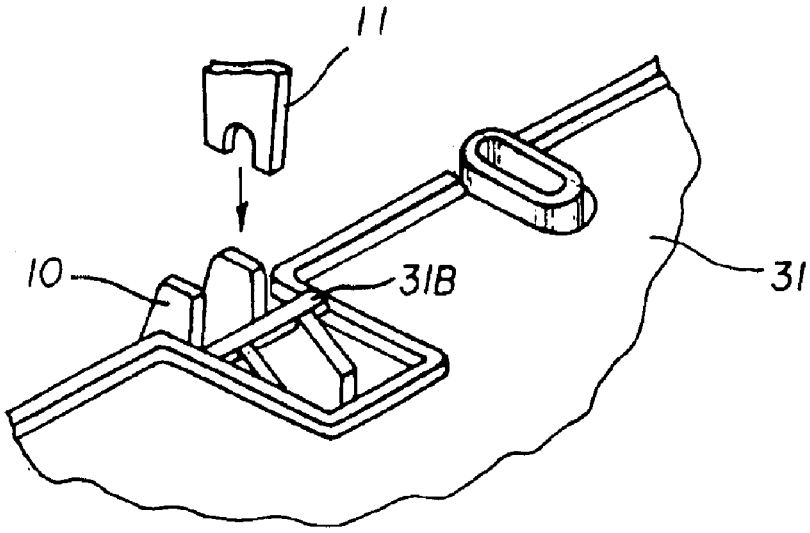
FIG. 6 illustrates a pivot point.

As shown in FIG. 3, the handle member 31 is comprised of a base 31A, a pivot 31B, an operating part 31C, and claws 31D, and is configured as an integral unit. A pair of first U-shaped grooves 10 formed on an upper surface of the external member 2C and a second U-shaped groove 11 formed in the internal member 2B cooperate with each other to support the pivot 31B such that the pivot 31B may rotate (See FIG. 6). With this arrangement, in the cover member 2, the handle member 31 is capable of rotating about an axis of the pivot 31B. The operating part 31C protrudes forward from the base 31A, and passes through a hole 12 formed in the front part of the external member 2C when the handle member 31 is mounted on the cover member 2. The respective claws 31D extend from the lower sides of both side ends of the base 31A to be substantially L-shaped so that the claws 31D can be engaged with latch holes 40 formed in the side walls 3 of the box body 3. Each of the claws 31D has a chamfering part 50 at an end thereof as shown in FIG. 4. The chamfering part 50 is intended to smoothly engage the claws 31D with the latch holes 40 while preventing the ends of the claws 31D from being caught on edges of the latch holes 40.

The spring member 33 is formed of a plate spring as shown in FIG. 3. As shown in FIG. 2, the spring member 33 passes through a slit formed substantially at the center of the handle member 31 to be fixed to the handle member 31 by screws, not shown. As shown in FIG. 2, an end of the spring member 33 is abutted against a rib 35, which is integrated with the internal member 2B, in the state in which the handle member 31 is supported by the internal member 2B and the external member 2C such that the handle member 31 may rotate. Therefore, pushing up the operating part 31C against the force applied by the spring member 33 causes the handle member 31 to rotate about the axis of the pivot 31B. This releases the claws 31D from the latch holes 40 to enable the cover member 2 to turn.

A description will now be given of the opening and closing actions of the cover member 2.

When the cover member 2 is closed, the claws 31D are engaged with the latch holes 40 formed in the side walls 3 as shown in FIG. 1 to prevent the cover member 2 from being opened unnecessarily when the vehicle is running or at other times.

To open the cover member 2, the operating section 31C is pushed up against the force applied by the spring member 33. The handle member 31 rotates about the axis of the pivot 31B. Since the pair of claws 31D formed at both side ends of the handle member 31 also rotate with the rotation of the handle member 31, the cover member 2 can be turned upward by releasing the claws 31D from the latch holes 40.

The latch device 30 according to the present embodiment constructed as described above eliminates the necessity of providing the box body 1 with a front wall. Specifically, since the latch device 30 utilizes the side walls of the box body 1, no restrictions are imposed on the presence or absence of a front wall and the shape of a front wall, thus increasing the degree of design freedom as to a front wall.

It is to be understood, however, that there is no intention to limit the invention to the above described embodiment, but certain changes and modifications may be possible within the scope of the appended claims. For example, although in the above described embodiment, the box body 1 has no front wall, the present invention may be applied to a box body having a front wall as in the prior art.

Further, although in the above described embodiment, the cover member 2 is mounted on the rear wall 4 of the box body 4 via the hinge device 20 such that the cover member 2 may turn in the longitudinal direction of the vehicle, the present invention is not limited to this, but the cover member 2 may be mounted on a side wall via a hinge device such that the cover member 2 may rotate in the direction of the width of a vehicle.

What is claimed is:

1. A latch arrangement for a storage compartment having at least a pair of walls and an upside opening, and a cover member pivotally mounted to said storage compartment to enable access through said upside opening, said latch arrangement comprising:

a handle member mounted to said cover member, said handle member comprising a pair of claws located adjacent to both sides of said cover member; and latch holes formed in the walls of said storage compartment such that said pair of claws engage said latch holes when the cover member closes the upside opening, wherein said handle member includes a pivot that is supported by substantially U-shaped grooves formed in said cover.

2. A latch arrangement according to claim 1, wherein said pair of claws are substantially L-shaped.

3. A latch arrangement according to claim 1, wherein said pair of claws each includes a chamfering part at an end thereof.

4. A latch arrangement according to claim 1, wherein said cover member comprises an internal member and an external member, and said handle member is disposed between said internal member and said external member.

5. A latch arrangement according to claim 1, wherein said cover member comprises an internal member and an external member, and said handle member is disposed between said internal member and said external member, and wherein the U-shaped grooves are formed in one of said external member and said internal member to enable said cover to rotate relative to the storage compartment.

6. A latch arrangement for a storage compartment including at least a pair of side walls and an upside opening, and a cover member pivotally mounted to the storage compartment to enable access through said upside opening said latch arrangement comprising:

a handle member mounted to said cover member, said handle member including a pair of claws positionable adjacent to ends of said side walls; and latch holes formed in the ends of said side walls, said pair of claws engaging the side walls forming said latch holes when the cover member closes the upside opening, wherein said cover member comprises an internal member and an external member, and said handle member is disposed between said internal member and said external member, and wherein said handle member includes a pivot that is supported by substantially U-shaped grooves formed in one of said external member and said internal member to enable the cover to rotate relative to the storage compartment.

7. A latch arrangement according to claim 6, further comprising a spring member fixed to said handle member, wherein said internal member has a rib formed on a lower surface thereof, and said spring member abuts said rib.

* * * * *